US005277467A

United States Patent [19]

Hepworth et al.

[11] Patent Number: 5,277,467

[45] Date of Patent: Jan. 11, 1994

[54] STACKABLE, FOLDABLE, SNAP-ON CARTON HOLDER

[76] Inventors: Allen Hepworth; Gordon Smith, both of c/o Paul D. Gornall, Barrister & Solicitor, 960 - 355 Burrard St., Vancouver, Canada, V6C 2G8

[21] Appl. No.: 977,116

[22] Filed: Nov. 16, 1992

[51] Int. Cl.[5] ..... A47J 45/00; B65D 23/10

[52] U.S. Cl. ..... 294/31.2; 220/758

[58] Field of Search ..... 294/27.1, 31.2, 32, 294/33; 220/737, 756, 758, 759

[56] References Cited

U.S. PATENT DOCUMENTS

| | | | |
|---|---|---|---|
| 2,782,064 | 2/1957 | Montgomery | 294/31.2 |
| 2,936,068 | 5/1960 | Munkachy | 220/737 |
| 3,021,026 | 2/1962 | Clare | 294/27.1 X |
| 3,250,562 | 5/1966 | Frasure et al. | 294/31.2 |
| 3,421,789 | 1/1969 | Klomparens | 294/31.2 |
| 3,615,115 | 10/1971 | Simms | 294/31.2 |
| 3,674,300 | 7/1972 | Simms | 294/31.2 |
| 4,964,536 | 10/1990 | Vestering | 294/31.2 X |

*Primary Examiner*—David M. Mitchell
*Assistant Examiner*—Dean J. Kramer

[57] ABSTRACT

This invention relates to carton holders that fit over cartons to assist in pouring from the carton, and in particular provides a carton holder that can be shipped in a one-piece, stackable orientation, can be folded along molded hinging joints, can be snapped, with a joint of interlocking tabs and slots, permanently into shape to fit over a carton, and can be slid into position on the carton such that the carton will not slip down through the carton because of upper bent tangs on the holder. The tangs are flexible, allowing the holder to be slid down and off the carton for re-use on another carton.

6 Claims, 3 Drawing Sheets

FIG. 3
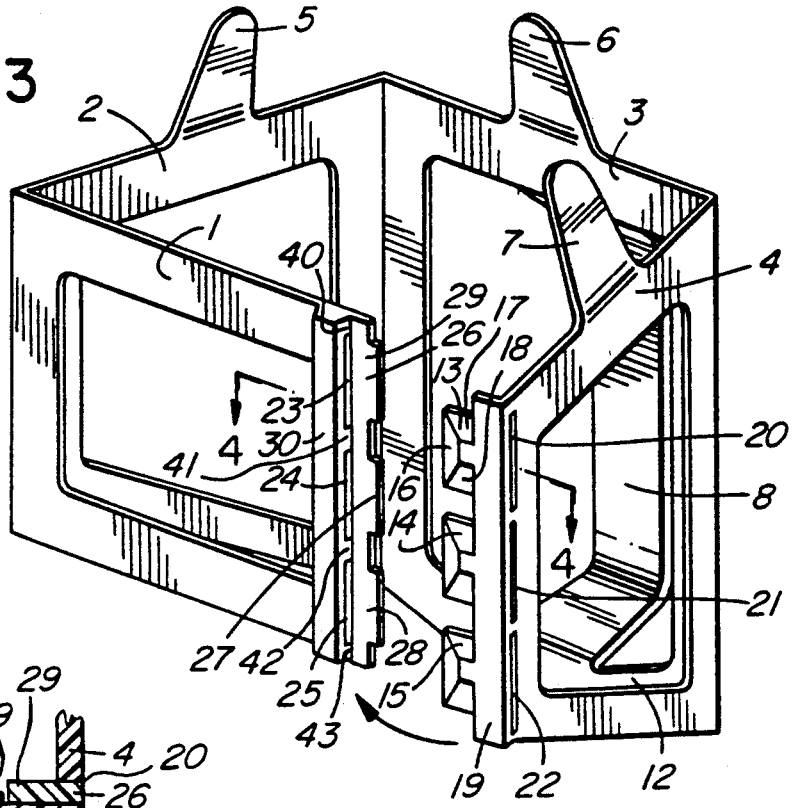
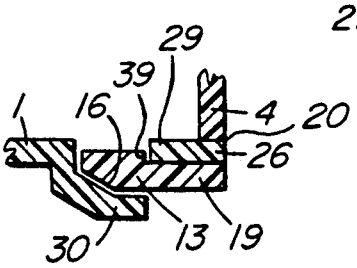
FIG. 4
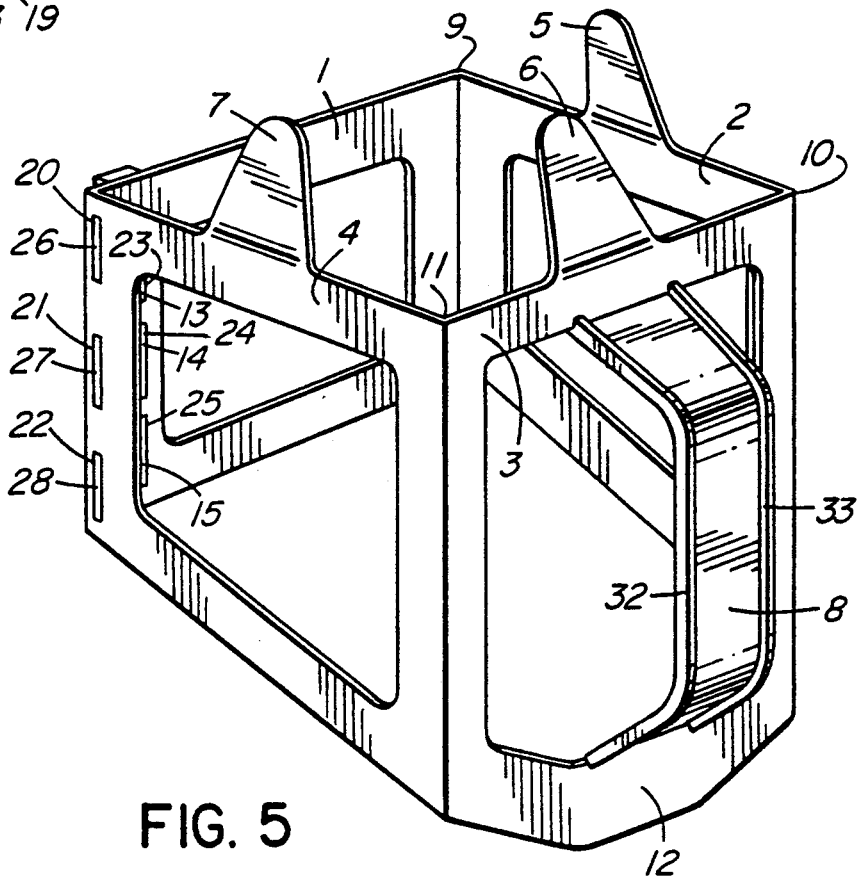
FIG. 5

STACKABLE, FOLDABLE, SNAP-ON CARTON HOLDER

FIELD OF THE INVENTION

This invention relates to carton holders that fit over cartons to assist in lifting the carton and in pouring a liquid from the carton.

DESCRIPTION OF THE PRIOR TECHNOLOGY

Previous holders for liquid containers have been been patented. For example, U.S. Pat. No. 4,296,958 shows a detachable container holder with a handle in which a portion of the holder engages the container, but it lacks the side portions and bent tangs of the present invention. Another holder, with sides to surround a carton for liquids and a single tab to fit under a top fold in the carton, is shown in U.S. Pat. No. 3,250,562, but it does not have the multiple angled tangs and snap-together features of the present invention. None of the prior technology discloses the features of the present invention.

SUMMARY OF THE PRESENT INVENTION

This invention relates to carton holders that fit over cartons to assist in pouring from the carton, and in particular provides a carton holder that can be shipped in a one-piece, stackable orientation, can be folded along molded hinging joints, can be snapped, with a joint of interlocking tabs and slots, permanently into shape to fit over a carton, and can be slid into position on the carton such that the carton will not slip down through the carton because of upper bent tangs on the holder. The tangs are flexible, allowing the holder to be slid down and off the carton for re-use on another carton.

DESCRIPTION OF THE DRAWINGS

FIG. 3 is a perspective view, showing the device of FIG. 1 folded and ready to be snapped into a shape for use on a carton.

FIG. 4 is a top cross-sectional view of the snap-together joint of the device of FIG. 1 after the joint has been snapped together, taken at line 4 from FIG. 3.

FIG. 5 is a perspective view of the device of FIG. 1 after it has been snapped together into a shape for use on a carton.

DETAILED DESCRIPTION

Figure 1:
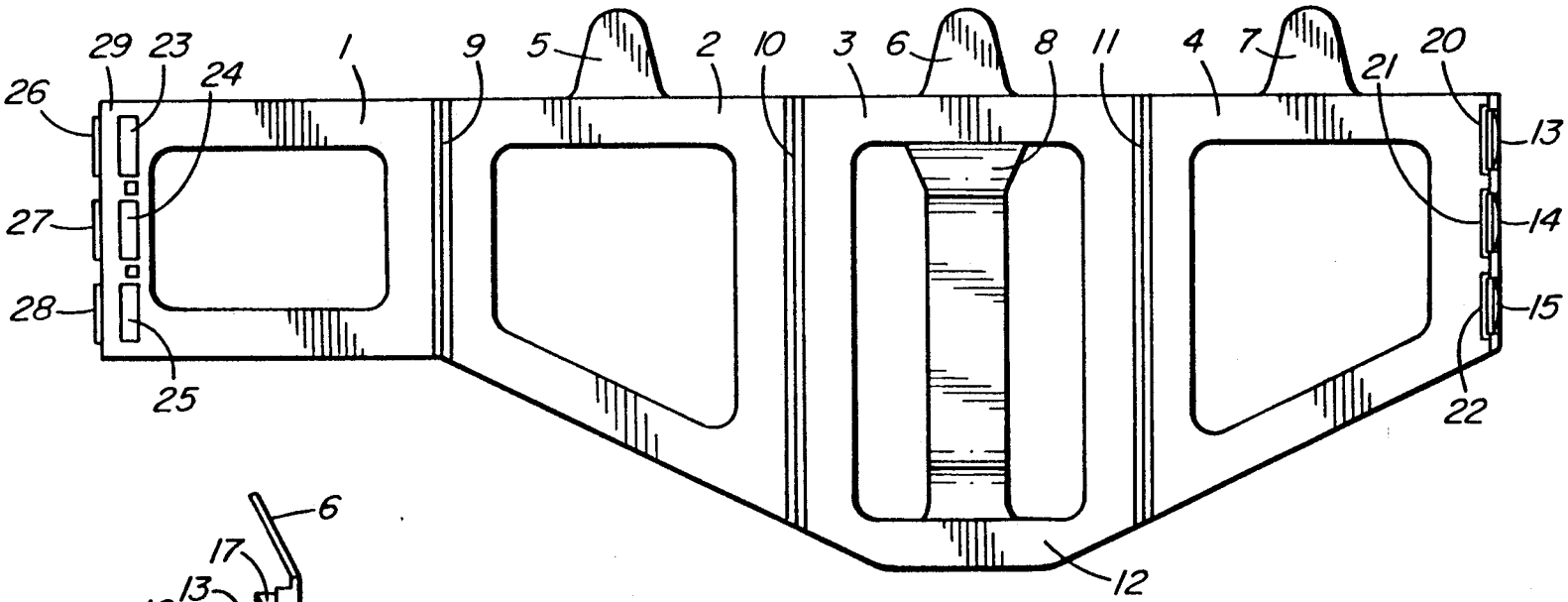
FIG. 1 is a bottom view of a preferred embodiment of the present invention, with the carton holder in a stackable shape suitable for storage and shipping with other such holders.
Figure 2:
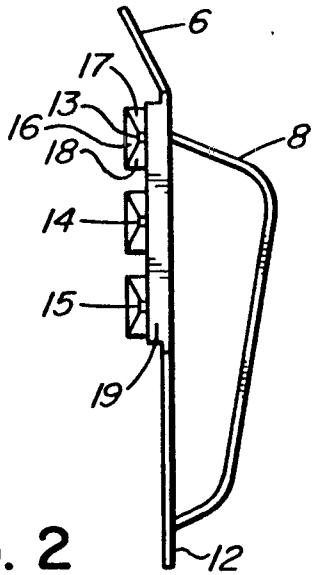
FIG. 2 is a side view of the device of FIG. 1 in its stackable shape.

Referring to FIGS. 1, 2, 3, and 5, the carton holder has a front side portion 1, a right side portion 2, a back side portion 3, and a left side portion 4. The right side portion 2 has a right bent tang 5. The back side portion 3 has a back bent tang 6. The left side portion 4 has a left bent tang 7. The handle 8 extends back from the back side portion 3. The front side portion 1 is joined to the right side portion 2 with a flexible hinge joint 9. Likewise the right side portion 2 and the back side portion 3 are flexibly joined along the flexible hinge joint 10, and the back side portion 3 and the left side portion 4 are flexibly joined along the flexible hinge joint 11. The back side portion 3 has a lower portion 12 below the handle 8 that extends beyond the size of the other side portions in order to provide a suitable handle size for the user without using unnecessary material for the other side portions. The left side portion 4 has a snap-together fitting comprising upper snap tab 13, middle snap tab 14 and lower snap tab 15, shaped to snap into the complementary snap-together fitting on the front side portion 1 comprising upper snap slot 23, middle snap slot 24, and lower snap slot 25. The complementary snap-together fitting on the front side portion 1 also comprises an upper tab 26, a middle tab 27, and a lower tab 28, shaped to slide respectively into upper slot 20, middle slot 21, and lower slot 22, in the snap-together fitting of the left side portion 4. The snap tab bar 19 from which the snap tabs 13, 14, and 15 extend will abut the tab bar 29 from which the tabs 26, 27 and 28 extend and the struts 40, 41, 42, and 43 of the snap slot bar 30 by which the snap slots 23, 24, and 25 are formed. The snap tabs have bevelled faces to assist in guiding the snap tabs into the snap slots. The leading bevelled face 16, the upper bevelled face 17, and the lower bevelled face 18 on the upper snap tab 13 ar shown.

Referring to FIG. 4, the snap slot bar 30 of the front side portion 1 fits tightly over the bevelled face 16 of the snap tab 13. The snap tab 13 has a retaining lip 39 to keep the snap-together fitting from being dislodged once the snap tabs have been snapped into place in the snap slots. The tab bar 29 extends into the upper tab 26, which fits into the upper slot 20. The tab bar 19 from which the upper snap tab 13 extends abuts the tab bar 29 and the upper tab 26. The snap joint formed by the intermeshing of the snap fitting on the left side portion 1 and the complementary snap fitting on the front side portion 1 is not intended to be reopened once it is snapped into the closed position. The close fit of the snap joint keeps the front side portion 1 stiffly perpendicular to the left side portion 4 of the holder. The other hinge joints of the holder are thus kept in roughly perpendicular orientation, enabling the holder to fit readily over a carton having square corners.

Referring to FIG. 5, the handle 8 comprising a left ridge 32 and a right ridge 33 to strengthen the handle 8.

Figure 6:
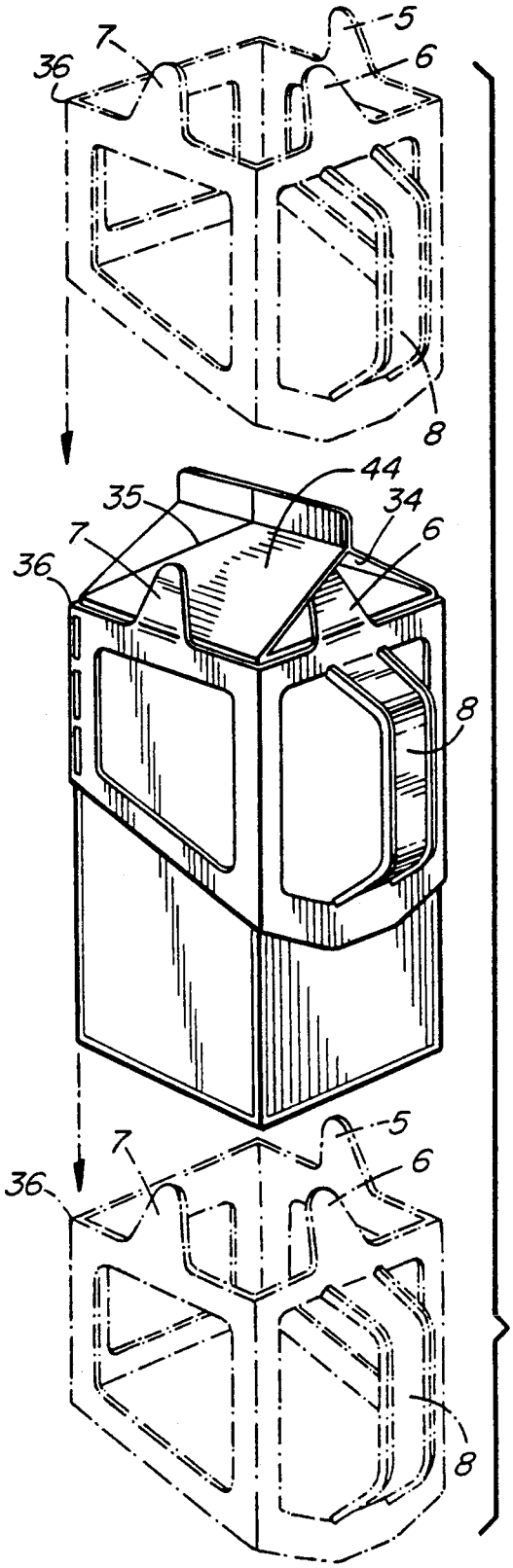
FIG. 6 is a perspective showing the process of sliding the device of FIG. 1 onto a carton.

Referring to FIG. 6, after the snap joint 36 is snapped together, the holder is gripped by the user on the handle 8 and slid over the top of the carton 44. The left bent tang 7, the back bent tang 6, and the right bent tang 5 are flexible, allowing the back bent tang 6 to bend back and around the eave 34 of the carton 44 into a position under the eave 34. The back bent tang 6 then prevents the holder from slipping up off the carton, enabling the user to grasp the handle 8 and lift the holder and the carton 44 together for pouring from a spout formed by folding back the carton top along the spout line 35. Because all the bent tangs are flexible, the holder can be slid downward off from the carton when the carton is to be discarded. The holder can thus be reused on another cartion.

Figure 7:
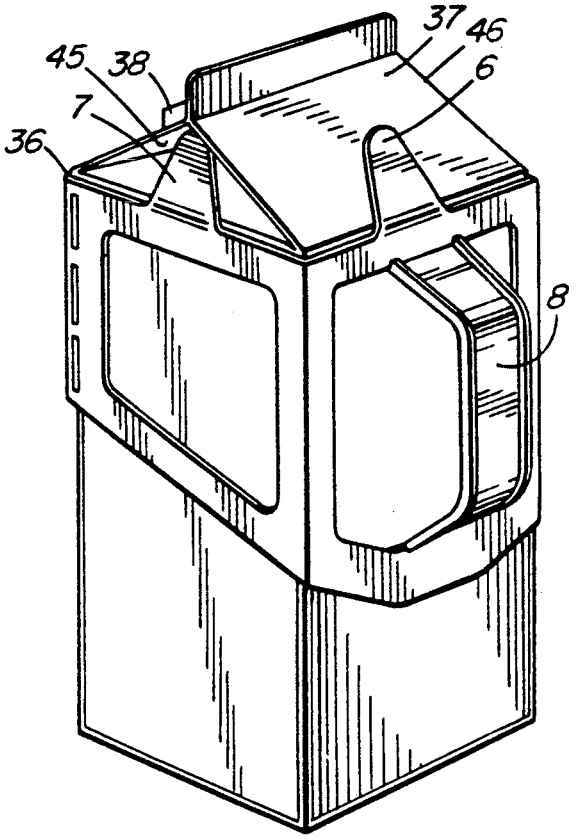
FIG. 7 is a perspective showing the device of FIG. 1 in position on a carton having a pouring spout instead of an fold-open spout.

Referring to FIG. 7, the holder is also adapted for use on a carton 37 having a special pouring spout 38 for use instead of a fold-back spout. The left bent tang 7 fits under the eave 45 of the top of the carton 37. The right bent tang of the holder would fit under the right side eave 46 on the top of the carton.

The within-described invention may be embodied in other specific forms and with additional options and accessories without departing from the spirit or essential characteristics of the invention. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. A carton holder for fitting over a carton to assist a user in lifting the carton and in pouring a liquid from the carton, the carton holder having a handle and a body comprising:

a) a plurality of hinge joints enabling the body to be folded into a shape adapted to be slid downward over a carton;

b) a snap joint fitting on one side portion and a complementary snap joint fitting on another side portion, enabling the body after being folded to be snapped into the shape adapted to be slid downward over a carton;

c) at least one flexible bent tang extending up and inward from a side portion of the body, enabling the body, after being folded and snapped into the shape adapted to be slid downward over a carton, to be retained from upward movement under an eave formed in a top of the carton;

in which the snap joint fitting on one side portion and the complementary snap joint fitting on another side portion comprises a plurality of snap tabs and complementary snap slots.

2. The carton holder of claim 1, in which the snap joint fitting on one side portion comprises a plurality of snap tabs and a plurality of slots, and the complementary snap joint fitting on another side portion comprises a plurality of snap slots, and a plurality of tabs, the snap tabs being adapted to snap into and be retained by the snap slots, and the slots being adapted to receive the tabs.

3. The carton holder of claim 2, in which the joint formed by the snap joint fitting and the complementary snap joint fitting is a rigid, perpendicular joint to keep the one side portion perpendicular to the other side portion.

4. The carton holder of claim 3, in which the snap tabs have retaining lips that fit behind a tab bar to keep the snap joint fitting interlocked with the complementary snap joint fitting.

5. The carton holder of claim 4, in which the snap tabs each have at least one bevelled face to guide the snap tabs into the respective snap slots.

6. The carton holder of claim 5, in which the body is a one-piece body having three molded hinge joints defining four side portions of the body, the four side portions being a front side portion, a right side portion, a back side portion with the handle integral thereto, and a left side portion, the right side portion having a right bent tang, the back side portion having a back bent tang, and the left side portion having a left bent tang, each tang extending upward and inward from its respective side portion after the body has been folded and snapped into the shape adapted to be slid downward over a carton, enabling the holder to be retained from upward movement under one or more eaves formed in a top of the carton, while enabling the holder to be removed from the carton by a continued downward movement for reuse on another carton.

* * * * *